US006794989B2

(12) United States Patent
Naegely et al.

(10) Patent No.: US 6,794,989 B2
(45) Date of Patent: Sep. 21, 2004

(54) SPORTS SIGNALLING DEVICE FOR HEARING IMPAIRED PERSONS

(76) Inventors: Kara Jean Naegely, Bayer Corporation, 100 Bayer Rd., Pittsburgh, PA (US) 15205-9741; Lara Terminiello, Bayer Corporation, 100 Bayer Rd., Pittsburgh, PA (US) 15205-9741; Shannon Fitzgerald, Bayer Corporation, 100 Bayer Rd., Pittsburgh, PA (US) 15205-9741

( * ) Notice: Subject to any disclaimer, the term of this patent is extended or adjusted under 35 U.S.C. 154(b) by 111 days.

(21) Appl. No.: 10/174,802

(22) Filed: Jun. 19, 2002

(65) Prior Publication Data

US 2003/0006903 A1 Jan. 9, 2003

Related U.S. Application Data

(60) Provisional application No. 60/300,613, filed on Jun. 25, 2001.

(51) Int. Cl.[7] ..... G08B 23/00

(52) U.S. Cl. ..... 340/573.1; 340/407.1; 340/539.11; 340/815.65; 340/825.19; 434/247; 482/1

(58) Field of Search ..... 340/407.1, 691.1, 340/691.4, 691.5, 815.4, 815.65, 539.11, 323 R, 573.1, 825.19; 482/1; 434/247; 704/271

(56) References Cited

U.S. PATENT DOCUMENTS

| | | | | | |
|---|---|---|---|---|---|
| 4,297,677 | A | * | 10/1981 | Lewis et al. | 340/540 |
| 4,380,759 | A | | 4/1983 | Sulkoski et al. | 340/407 |
| 4,777,474 | A | | 10/1988 | Clayton | 340/539 |
| 4,853,674 | A | | 8/1989 | Kiss | 340/407 |
| 5,047,952 | A | * | 9/1991 | Kramer et al. | 704/271 |
| 5,251,253 | A | * | 10/1993 | Chutuk | 379/102.03 |
| 5,319,355 | A | * | 6/1994 | Russek | 340/573.1 |
| 5,734,976 | A | * | 3/1998 | Bartschi et al. | 455/333 |
| 6,072,395 | A | * | 6/2000 | Vega | 340/573.1 |
| 6,151,278 | A | | 11/2000 | Najarian | 368/12 |
| 6,181,236 | B1 | | 1/2001 | Schneider, Jr. | 340/326 |
| 6,533,706 | B2 | * | 3/2003 | Morrow | 482/1 |
| 2002/0145522 | A1 | * | 10/2002 | Pembroke | 340/573.1 |

FOREIGN PATENT DOCUMENTS

WO WO 01/76265 * 10/2001

OTHER PUBLICATIONS

JTECH (date unavailable) Applications: hospitality pagers, restaurant pagers.

* cited by examiner

*Primary Examiner*—Thomas J Mullen, Jr.
(74) *Attorney, Agent, or Firm*—Joseph C. Gil; Jennifer R. Seng

(57) ABSTRACT

The present invention relates to an apparatus and method for providing instructions to a hearing impaired individual performing a sports activity thereby instructing the hearing impaired individual to perform a particular action in a sports activity.

3 Claims, 2 Drawing Sheets

RECEIVER

SPORTS SIGNALLING DEVICE FOR HEARING IMPAIRED PERSONS

This application claims the benefit of provisional application Ser. No. 60/300,613 filed Jun. 25, 2001.

FIELD OF THE INVENTION

The present invention relates to an apparatus and method for providing instructions to a hearing impaired individual performing a sports activity thereby instructing the hearing impaired individual to perform a particular action in a sports activity.

BACKGROUND OF THE INVENTION

Most individuals are born with the ability to smell, taste, feel, see and hear. But there are many less fortunate individuals who are deprived of some of these senses. In the United States alone, there are approximately twenty-eight (28) million individuals who are either deaf or hard of hearing. And, approximately 1,465,000 individuals, ages 3 or older, are deaf in both ears. Out of all the children in the U.S., approximately 14.9% have either high or low frequency hearing loss.

Many children and adults play sports. However, to play sports, in particular, team sports, it is important for the individual to be able to observe the surroundings of the sporting event, and take an appropriate action. For example, in a basketball game, a coach may want a player to foul another player. The hearing impaired player would not be able to receive such instructions unless the coach could be directly observed. Another example is a soccer player. There are times when a coach needs to relay actions such as "stop in play", "come off the field" and "move toward the action" to the player. Presently, many coaches use colored flags and hand signals to alert the players. However, this method of coaching is difficult because the coaches are constantly working to get the player's attention during the game.

There are devices created to assist deaf individuals in sports. For example, there is a device to assist hearing impaired individuals play hockey. In this device, a blue light is placed in the hockey helmet near the eye dominant. When the light, which is controlled by the referee, flickers, it signals the deaf player to get off the ice or to stop because of an end in play.

Another known device is for deaf swimmers. A device, which was used in the 2000 Olympics, used a flashing strobe light, instead of a whistle to signal the start of the swim for the swimmers.

Other devices are known for providing a signal to the hearing impaired. Kiss (U.S. Pat. No. 4,853,674) discloses a wireless alarm system containing a transmitter and receiver for signalling the occurrence of monitored events such as an audible event to a hearing impaired person. The receiver contains a vibration signal and a second signal which may be an electric shock.

Clayton (U.S. Pat. No. 4,777,474) discloses an alarm apparatus for a hearing impaired person containing a base station which contains a transmitter. The apparatus also contains a portable unit containing the receiver.

Sulkoski, et al. (U.S. Pat. No. 4,380,759) discloses a smoke detector apparatus to alert a deaf person of a fire. The apparatus contains a transmitter having a vibration sensor connected to a transmitter and a receiver to receiving the transmitted signal.

Schneider Jr. (U.S. Pat. No. 6,181,236) discloses a sports whistle which attempts to overcome crowd noise by using a conventional whistle to initiate a wireless signal simultaneous with the audible signal. A receiver then receives the wireless signal and uses it to initiate a variety of visual signals that can be ascertained by both spectators and television viewers. The visual signal can be a flash of light, movement of an object or an indication on a television screen.

Najarian (U.S. Pat. No. 6,151,278) discloses an awakening device that acts as an alarm clock. An alarm signal can be programmed and when it is set off, the signal is sent to a receiver, which is strapped to or held against the user's body. A vibrating mechanism is utilized to awaken the user without relying on the audible alarm.

The above-mentioned devices are utilized to alert the hearing-impaired of a particular event. However, none of the above-mentioned devices enable and allow a hearing impaired or deaf individual to play a sport or a team sport.

SUMMARY OF THE INVENTION

Therefore, the present invention relates to a wireless device useful for hearing impaired persons for enabling said person to receive instructions while participating in a sport-related activity comprising:

a) a transmitter unit comprising at least one means for receiving a physical impulse for transmitting an instruction as a wireless output signal;

b) a portable unit adapted to be carried by the hearing impaired person responsive to said wireless signal thereby providing an instruction to said person by generating at least one signal to said hearing impaired person.

DETAILED DESCRIPTION OF THE INVENTION

Figure 1:
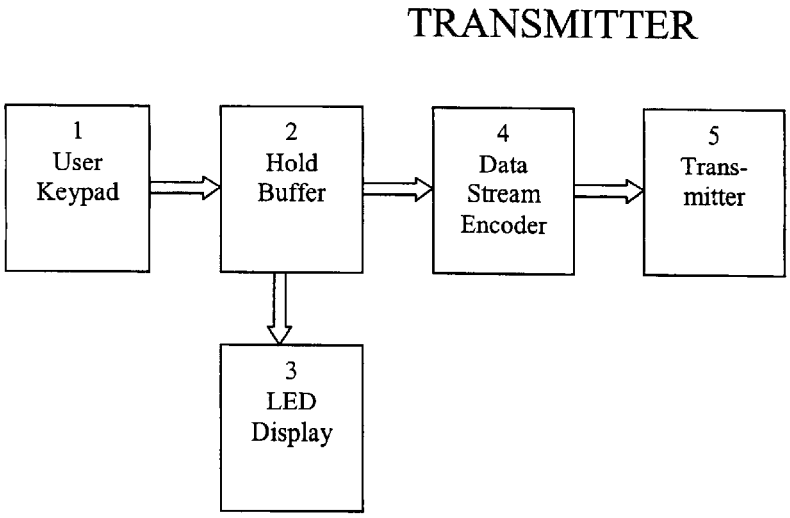
FIG. 1 shows a block diagram of a transmitter of the present invention.

The present invention relates to a device which will enable a hearing impaired person to play sports, in particular team sports. In an embodiment of the present invention, as shown in FIG. 1, the coach selects the code to send to the player's receiver by pressing the corresponding key on the Transmitter User Keyboard 1. In the present invention, there can be a number of keys depending on the number of different instructions or actions a coach wants to transmit to the hearing impaired player. In a preferred embodiment, the keys can be color-coded, each key containing a different color corresponding to an instruction. Additionally, the keys can also be numbered to identify each key.

The User Keyboard 1 is composed of simple momentary switches. When a key is pressed, the signal is stored in a Hold Buffer 2. The Hold Buffer 2 is formed from D flip flop gates. The stored Hold Buffer 2 signal is used by the LED Display 3 to indicate and confirm which codes are being sent. The LED Display 3 is made from 3 discrete LEDs (red, green and yellow). The 3 different LED colors enable the system to represent 8 codes. The stored Hold Buffer 2 signal is also sent to the Data Stream Encoder 4 where it awaits the pressing of the send key from the User Keyboard 1. The Data Stream Encoder 4 can be any encoder used for remote control system applications (i.e. Holtek HT12E). The Data Stream Encoder 4 must be compatible with the Data Stream Decoder 7 used in the Receiver. Once the codes are set by the coach, the coach then presses the send key. Pressing the send key allows the Data Stream Encoder 4 to load the stored codes, encode them and transmit them to the receiver via the Transmitter 5. The Transmitter 5 can be of any frequency or power allowed by the FCC for public use (i.e. e 433 MHz, 900 MHz, 2.4 GHz, etc.). The Transmitter 5 must be compatible with the operating frequency and power of Receiver 6 used in the Receiver. In order to conserve battery power, the Transmitter 5 will only be on when the send button is actively being pressed.

Figure 2:
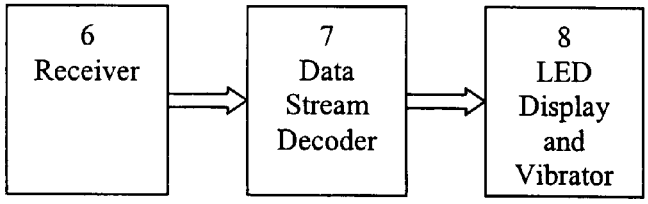
FIG. 2 shows a block diagram of a receiver of the present invention.

As shown in FIG. 2, the encoded transmitted signal is acquired by the player wearing a Receiver via Receiver 6. The Receiver 6 can be of any frequency or power allowed by the FCC for public use (i.e. e 433 MHz, 900 MHz, 2.4 GHz, etc.). The Receiver 6 must be compatible with the operating frequency and power of Transmitter 5 used in the Transmitter. The Receiver 6 processes the signal received from Transmitter 5 and sends it to the Data Stream Decoder 7 where it is decoded. The Data Stream Decoder 7 can be any decoder used for remote control system applications (i.e. Holtek HT12D). The Data Stream Decoder 7 must be compatible with the Data Stream Encoder 4 used in the Transmitter. The Data Stream Decoder 7 then produces signals, which are used to activate the LED Display 8 and Vibrator 8. The Vibrator 8 turns on alerting the player of a code and the LED Display 8 shows that code. The LED Display 8 is made from 3 discrete LEDs (red, green and yellow). The 3 different LED colors enable the system to represent 8 codes. The codes displayed can be color or alphanumeric codes. Preferably, the displayed codes are color codes. The Vibrator 8 is a typical vibrating motor found in pagers. In order to conserve battery power the Vibrator 8 will only be on when the send button on the Transmitter is actively being pressed.

In another embodiment of the present invention, with additional switching circuitry, the system has the capability to selectively address 256 individual receivers, each being able to represent 16 codes. This capability allows multiple users of the system to be active without interfering with one another.

The receiving device can be worn on the player's wrist much like a watch. For example, the receiver can be attached to a velcro band which then is worn on the wrist. Additionally, another contemplated embodiment is the receiver device being split into two (2) devices, a headband comprising the vibrator mechanism and the wrist device comprising the LED signals. Certainly, the receiver, either in one or multiple parts, can be placed on any part of the body through devices or attachments known in the art.

Therefore, for example, in a soccer game, a hearing impaired person will wear the portable receiver much like a person wears a wristwatch. During a game situation, if the coach wishes the hearing impaired player to "move toward the action", the coach will depress the key corresponding to such action on the transmitter. The instruction is stored in the transmitter until the coach presses the "send" key. The receiver, which is fastened to the player, processes and decodes the signal. First, a vibrating signal is activated which alerts the player that an instruction is forthcoming from the coach. Then, the player looks at the LED display on the transmitter which displays a code. For example, a red code can signify "stop in play", a yellow code can signify "come off the field" and a green code can mean "move toward the action". Of course, the present invention contemplates a receiver having at least one visual signal and up to as may signals as deemed necessary.

The present invention, while certainly being of use to allow hearing impaired individuals to play sports, can also be used in non-sporting activities, such as allowing parents or guardians of a deaf/hard of hearing child to call him/her in from outside play. Additionally, with two (2) units, a parent (or other adult) can have a two way "conversation" with a deaf/hard of hearing child (or adult). In a Summer/Day Camp environment, a camp counselor can have contact with deaf/hard of hearing campers. In a noisy work place, there may be an employer who can communicate with the deaf/hard of hearing employee through such a device.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A wireless device useful for a hearing impaired person(s) for enabling said person to receive instructions from another person while participating in a sport-related activity comprising:

a) a transmitter unit comprising at least two means for receiving a physical impulse for transmitting instructions as a wireless output signal, wherein said means for receiving a physical impulse comprises at least two depressible buttons or keys;

b) a portable unit adapted to be carried by the hearing impaired person responsive to said wireless signal thereby providing instructions to said person by first generating a signal comprising a vibration and then generating a second signal providing a color illuminating visual signal(s), wherein each visual signal is in the form of a different color illumination and wherein each different color illumination individually corresponds to an individual depressible button or key of the transmitter unit.

2. A wireless device according to claim 1, wherein said portable unit is worn on the wrist.

3. A method for transmitting instructions to a hearing impaired person(s) playing sports comprising the steps of:

a) placing a first instruction into a transmitter;

b) transmitting said first instruction from a transmitter to a wireless receiver, wherein said wireless receiver is fastened to said person playing sports, wherein said first instruction initiates a vibrating signal received by the person playing sports;

c) placing a second instruction into the transmitter;

d) transmitting said second instruction from the transmitter to the wireless receiver, wherein said second instruction initiates a color illuminated visual signal;

e) placing additional successive instructions into the transmitter and transmitting said additional successive instructions from the transmitter to the wireless receiver, wherein said additional instructions successively initiate a vibrating signal and then a color illuminated signal.

* * * * *